US007497522B2

(12) United States Patent
Thornton et al.

(10) Patent No.: US 7,497,522 B2
(45) Date of Patent: Mar. 3, 2009

(54) PAVEMENT SAW WITH SELF-LEVELING OPERATOR HANDLE AND DEPTH CONTROL SYSTEM

(76) Inventors: Kenneth Thornton, 9415 W. Bienapfl Dr., Boise, ID (US) 83709-4831; Nathaniel Cody Batement, 11197 W. Springgold Dr., Boise, ID (US) 83709-6391; Douglas S. Prairie, 3949 S. Mill Site Ave., Boise, ID (US) 83716; Jeffrey K. Arnswald, 30 Moose La., Boise, ID (US) 83716

( * ) Notice: Subject to any disclaimer, the term of this patent is extended or adjusted under 35 U.S.C. 154(b) by 88 days.

(21) Appl. No.: 11/556,000

(22) Filed: Nov. 2, 2006

(65) Prior Publication Data

US 2007/0096540 A1 May 3, 2007

Related U.S. Application Data

(60) Provisional application No. 60/733,672, filed on Nov. 3, 2005.

(51) Int. Cl.
*B28D 1/04* (2006.01)

(52) U.S. Cl. ..... 299/39.3

(58) Field of Classification Search ..... 172/43; 299/39.3

See application file for complete search history.

(56) References Cited

U.S. PATENT DOCUMENTS

| | | | | |
|---|---|---|---|---|
| 3,533,120 | A | 10/1970 | De Mercado | |
| 4,115,890 | A | 9/1978 | Burgoon | |
| 4,312,603 | A | 1/1982 | Whiteman, Jr. | |
| 4,673,219 | A | 6/1987 | Perciful | |
| 5,056,499 | A | 10/1991 | Chiuminatta et al. | |
| 5,058,229 | A | 10/1991 | Plazanet | |
| 5,298,080 | A | 3/1994 | Von Vett | |
| 5,398,768 | A * | 3/1995 | Staples | 172/21 |
| 5,429,109 | A | 7/1995 | Chiuminatta et al. | |
| 5,570,677 | A | 11/1996 | Chiuminatta et al. | |
| 5,950,612 | A | 9/1999 | Zuzelo et al. | |
| 5,953,781 | A | 9/1999 | Sletten, II et al. | |
| 6,151,811 | A | 11/2000 | Barreto | |
| 6,276,291 | B1 | 8/2001 | Lapointe et al. | |
| 6,421,869 | B1 | 7/2002 | Olsson | |

FOREIGN PATENT DOCUMENTS

| | | |
|---|---|---|
| DE | 8714999 | 1/1988 |
| JP | 101801 | 4/1989 |
| JP | 087658 | 4/2005 |

OTHER PUBLICATIONS

Patent Abstract for JP087658.
JPatent Abstract for JP101801.
International Search Report for PCT/US2006/003195.

* cited by examiner

*Primary Examiner*—John Kreck
(74) *Attorney, Agent, or Firm*—Dykas, Shaver & Nipper, LLP; Frank J. Dykas

(57) ABSTRACT

A pavement cutting tool wherein the pitch of the handles relative to the ground surface is relative to, and interlinked, to the pitch of the connected saw blade, so that as the saw blade is raised and/or lowered into the surface to be cut, the handles remain at a predetermined angle of attack (preferably generally horizontal). The pavement-cutting tool further using a limit switch to limit the depth of the cut.

13 Claims, 6 Drawing Sheets

PAVEMENT SAW WITH SELF-LEVELING OPERATOR HANDLE AND DEPTH CONTROL SYSTEM

CROSS-REFERENCE TO RELATED APPLICATIONS

This application claims the priority date of the provisional application entitled CONCRETE SAW WITH SELF-LEVELING OPERATOR HANDLE filed by Jeffrey K. Arnswald, et al., on Nov. 3, 2005 with application Ser. No. 60/733,672, the disclosure of which is incorporated herein by reference.

FIELD OF THE INVENTION

The invention relates generally to powered pavement saws, and in particular, to a self-leveling operator handle for use upon powered pavement saws.

BACKGROUND OF THE INVENTION

A walk behind pavement saw is a device typically used to cut through pavement slabs (i.e., concrete), and/or to cut grooves/slots in pavement surfaces. A typical pavement saw is very heavy, often weighing hundreds of pounds, and is made up of a rigid frame that supports a powerful engine which drives a rotary saw blade.

In one such prior art device, the frame rests on a set of front and rear wheels, with a pair of operator handles rigidly mounted to the rear of the frame so that an operator who stands behind the saw can see and operate such a device. The handles are usually bolted, welded, or otherwise fixed to the frame in a single position and are not readily adjustable to accommodate different size operators. In some prior art devices, the handles are "adjustable" in their connection with the frame because the position of the handles on the frame can be changed by manually loosening a wing nut, manually changing the pitch of the handles and then manually tightening the wing nut so as to return the device to a fixed position in a different desired position.

In such prior art devices, the saw blade is typically mounted near the front of the frame so that the cutting edge of the blade is in front of or just below the front of the frame. The height of the saw blade is typically above the pavement work surface and the depth of the cut is controlled by the operator lifting or lowering the handles so as to raise or lower the front end of the frame.

In one such standard prior art device, neither the front or rear wheels are configured or allowed to pivot. The reason for this is to prevent lateral movement of the saw blade when cutting. Unacceptable lateral movement of a spinning saw blade in the cut would likely result in a shattered saw blade which would pose a danger to the operator and others nearby. While this non-pivoting feature is desirable as a safety measure, it makes the movement or steering of such a device much more difficult.

In prior art pavement cutting saws, the rigid fixation of the handles of the device, to the frame of the device, cause the handles to travel in an arc as the front of the frame, which the saw blade is connected to, is raised and lowered. For example, raising the front of the frame pivots the handles downwardly (towards the pavement surface) behind the rear of the frame. If the diameter of the saw blade is large, the operator must often raise the front of the frame very high, thus pivoting the handles downwardly to the extent that at times the handles are about at the height of the operator's knees or lower. Due to the great weight of power pavement saws, lowering the handles to just above the pavement work surface makes the saw difficult to maneuver and exposes the operator to fatigue and/or the possibility of injury. Instead, in order to move the saw to and from the site of the cut, or to turn the saw, the operator must raise the front of the frame well above the pavement surface, high enough to completely disengage the saw blade from the cut. The operator can then push down on the handles to pivotally lift the front wheels off the pavement surface and pivot the machine around on its rear wheels to effectuate turning. Alternatively, the operator may lift up on the handle so as to effectuate a turn upon the front wheels of the device.

Accordingly, there is a need for a way to maintain the handles at a comfortable height above the pavement surface, largely independent of the height of the saw blade, particularly when the operator of the saw is turning or moving the machine with the saw blade raised above the pavement surface. It is an object of embodiments of the present invention to provide a pair of self leveling handles for use with a pavement saw or other similar machine, which enables the position of the handle bars to remain in the same general orientation and position regardless while the frame and blade of a device are lifted and lowered. Another object of embodiment of the present invention is to provide a mechanism wherein the handle height may be readily and quickly adjusted for operators of different heights, or even operator preferences.

SUMMARY OF THE INVENTION

One embodiment of the present invention is a pavement-cutting tool having a self-leveling handle assembly. This cutting tool has a frame, a front wheel assembly, a leveling linkage and a handle assembly.

The frame is connected to an engine or motor that is configured for a driving connection to an attached saw blade. The frame further comprising a rear wheel assembly for supporting the rear of the tool above a pavement surface, and a front wheel assembly. The rear wheel assembly having at least one rear wheel and preferably two. Depending upon the necessities of the individual user, a skid or other type of support may replace the front wheels without changing the function or operation of the present invention.

The front wheel assembly includes a member that extends from a first end to a second end. The first end pivotally connected to the frame and the second end connected to at least one front wheel. The front wheel assembly also includes a pitch controller, which controls the pitch of the front wheel relative to the frame. In the preferred embodiment of the invention this is done by a hydraulic cylinder or other device that is operatively connected between the frame and the front wheel assembly, and which then functions to raise or lower this front frame assembly.

A leveling linkage interconnects the front wheel assembly with a handle assembly, which is described below. The leveling linkage has a first end and extends along a length to a second end. The first end of this leveling linkage is pivotally connected to the handle assembly. The second end of this leveling linkage is pivotally connected with the front wheel assembly.

The purpose of this handle assembly is to allow a user to control the cutting device. Preferably, therefore this device is made up of at least one handle bar, which has a first portion pivotally connected to the frame and a second portion pivotally connected to the leveling linkage.

In use, this combination of pieces functions together so that as the pitch controller increases and/or decreases the pitch of frame in relation to the surface upon which it is placed, the leveling linkage is appropriately and proportionally modified so as to absorb this pitch change and allow the handle bar to remain in a desired position. Typically, this is an orientation generally parallel to the underlying surface upon which the work is being done. This is a significant improvement over other prior art embodiments and devices which do not allow for a such modifications to take place, and wherein the handles of the concrete cutting device will travel in an arc as the placement of the cutting device is modified.

Still other features and advantages of the present invention will become readily apparent to those skilled in this art from the following detailed description which describes the preferred embodiment of the invention, simply by way of illustration of the best mode contemplated for carrying out this invention. As will be realized, the invention is capable of modification in various respects all without departing from the spirit and scope of the invention which is described in the claims. Accordingly, the drawings and description of the preferred embodiment are to be regarded as illustrative in nature, and not as restrictive.

DESCRIPTION OF THE PREFERRED EMBODIMENTS

Figure 1:
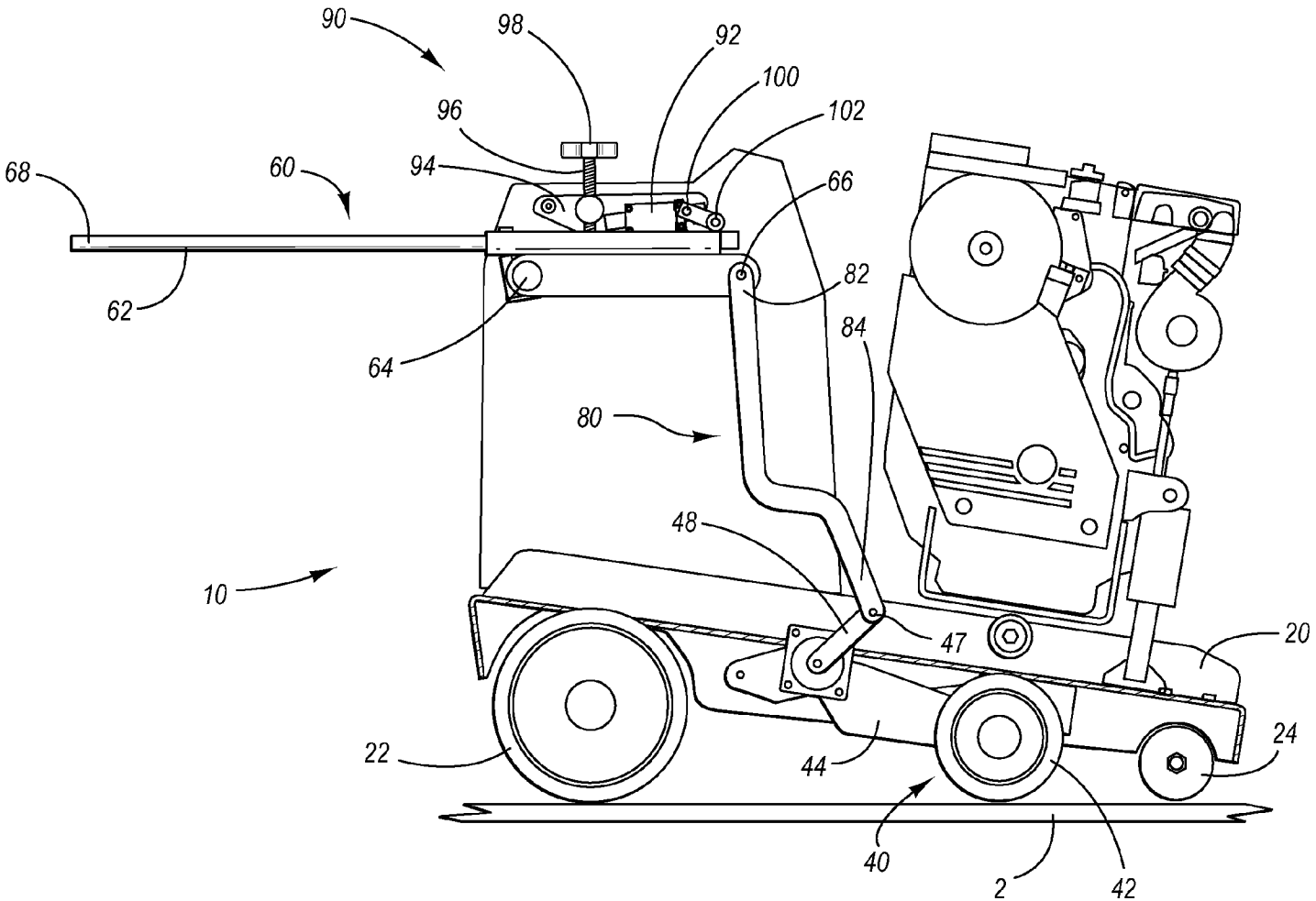
FIG. 1 is a side view of one embodiment of the present invention, showing the device in a "lowered" position.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is an improvement for pavement cutting tools as well as an improved pavement-cutting tool itself. While there are various embodiments of the present invention shown in the attached figures, one particular embodiment is shown in FIGS. 1 and 2.

Figure 2:
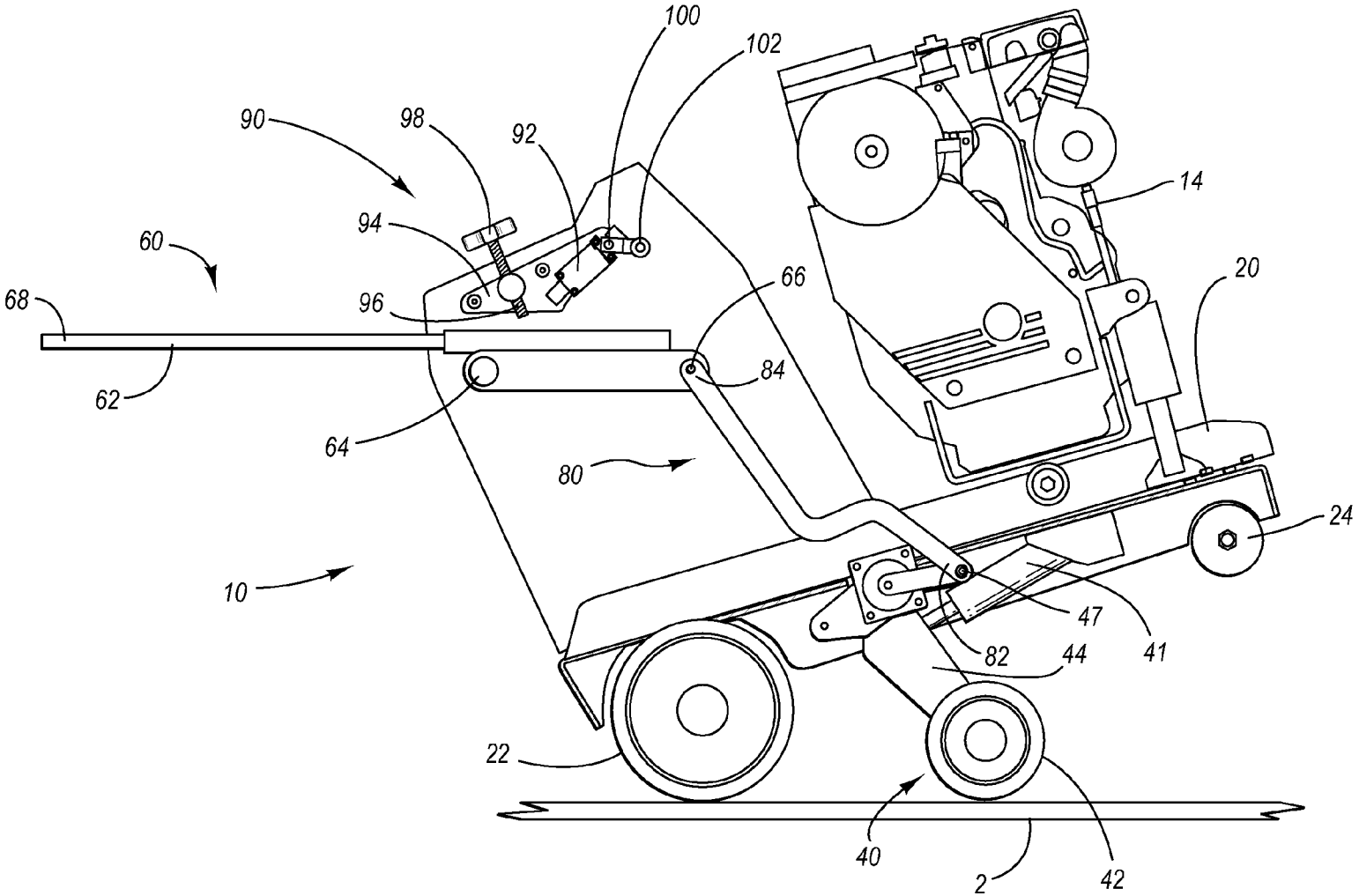
FIG. 2 is a second side view of the embodiment of FIG. 1, showing the "raised" position.

Referring initially to FIG. 1, a first embodiment of the present invention is shown. This figure shows a standard pavement cutting tool (pavement saw) 10 partially within its "lowered" mode. In this mode, a concrete cutting saw blade which is attached to the saw blade connection assembly 24 is able to engage and cut a pavement surface 2. These concrete cutting saw blades are generally large circular blades with a plurality of teeth interspaced around the perimeter of this blade. In order to show the features of the present invention, the saw blade of such the concrete cutter 10 shown in these figures is not shown. However, it is to be distinctly understood that the placement of a suitable and adequate saw blade upon the concrete cutting saw is a matter of application which may be individually adapted and varied according to the needs and necessities of the user.

The pavement-cutting tool 10 is made up of a frame 20, having a front wheel assembly 40 and a handle assembly 60. In such a pavement-cutting tool 10, the frame 20 is supported by at least one rear wheel 22 and at least one front wheel 42. A typical wheel configuration for such a device includes four-wheels, two-wheels in the front and two wheels in the back. However other configurations including embodiments with three wheels, arranged in various configurations may be appropriately modified to function within the scope of the present invention. Such wheels typically rest directly on the pavement work surface 2.

For purposes of illustration, in this preferred embodiment, a four wheel configuration is shown, and it should be understood that the drawings herein show one side of the pavement saw, with the other side being substantially identical. Depending upon the exact desires and necessities of the user, the configuration of the wheels may be modified to meet the individual needs of the user.

In the present invention, the handle assembly 60 and the front wheel assembly 40 are interconnected by a leveling linkage 80. This leveling linkage 80 is configured to adjust the orientation of the handle assembly 60 relative to the pitch of the frame 20 with regard to the front wheel assembly 40. The reason for doing this is to maintain the handles 62 at a comfortable height above the pavement surface 2, largely independent of the height of the saw blade. This is particularly useful when the operator of the saw is turning or moving the machine with the saw blade raised above the pavement surface 2. Various types of linkages are shown in the various embodiments of the invention which are shown in the attached figures and described hereinafter.

The teachings of the present invention could be applied to many different current commercial embodiments of pavement saws, other pavement equipment, and other construction equipment quite easily. As such, "pavement tool" and "frame" are only referred to in this disclosure in their generic sense rather than dictating individual components and others that are attached to this frame.

In a typical pavement cutting tool, a frame 20 is typically attached to a rear wheel 22 and the aforementioned saw blade assembly 24 is connected to a driving a saw blade via an engine, hydraulics or other means. In such a unit, the saw blade is rotatably attached to a forward frame section preferably in a fixed relation to an engine (or other manner of powering the blade). For instance, the blade could be driven by an engine via a belt assembly with a clutch assembly used to engage and disengage the belt assembly.

In the embodiment shown, a pitch controller 41 interconnects between the frame 20 and the front wheel assembly 40. This pitch controller assembly 41 being further pivotally attached to the frame 20. As shown more clearly in FIG. 2, the pitch controller 41 is a hydraulic ram attached between the frame 20 and the front wheel assembly 42 so that extension of the hydraulic ram 41 causes the front wheel assembly 42 to pivot away from the frame 20 thereby raising the front of the frame 20 above the pavement surface 2. While this embodiment utilizes a dual action hydraulic cylinder/ram to make such movement, it is envisioned that other apparatuses could also be used to control the pitch of the frame relative to the front wheel assembly, including but not limited to mechanically driven turnbuckles and other devices capable of performing such a task.

The front wheel assembly 42 has a pitch arm 44 that is pivotally connected to the frame 20 near one end and is connected to a front wheel 42 at or around a second end. Again, as indicated above, this pitch arm 44 functions in conjunction with the pitch arm controller 41 to control the pitch of the frame 20 above the surface upon which the pavement-cutting tool is used. This pitch modulation also allows the depth of the cut that is made by the saw blade to be varied by an operator according to a particular need.

A handle assembly 60 extends from the device, and is interconnected with the frame which supports all of the pieces of the present invention. This handle assembly 60 comprises at least one handle bar 62 (preferably two handle bars) which allow a user to manipulate and control directional movement of the cutting tool 10 while cutting. This also allows the tool to be manipulated into or out of a cutting location where it is to be used and/or stored.

The handle assembly 60 is connected to a leveling linkage 80 that interconnects this handle assembly 60 to the front wheel assembly 40. When the front wheel assembly is moved and the pitch between the frame 20 and the work surface 2 is changed. The leveling linkage 80 compensates for this movement or change in pitch of the cutting device 10. Therefore, as the orientation or pitch of the frame relative to the front wheel assembly is altered, the orientation of the handle 62 relative to the ground surface generally remains in the same level and position.

In the embodiment of the invention shown in FIGS. 1 and 2, this leveling linkage 80 is a non-linear piece of material that is pivotingly connected to the cutting device 10 so that regardless of the orientation of the frame 20 relative to the first wheel assembly 42, the handle 62 remains generally parallel to the plane of the ground surface. On other embodiments it may be desired to maintain the orientation of the handle 62 in a position different from a generally horizontally parallel one as is shown in the figures of the current specification. It should be distinctly understood that the present invention may be adapted to reflect these desired modifications.

In the embodiment of the invention shown in FIGS. 1 and 2, this leveling linkage 80 has a first end 82 which extends to a second end 84 along a generally non-linear length. The first end 82 is configured to connect with the handle assembly 60 at a pivot point 66. The second end of the leveling linkage 84 is configured to connect with an offset bar 48 at a pivot point 47. In the embodiment of the invention shown in FIGS. 1 and 2, the offset bar 48 is pivotally attached to a portion of the front wheel assembly whereby movement of the front wheel assembly 40 causes the offset bar 48 to be moved in any of a variety of positions with regard to the frame 20 of the device. The movement of the offset bar 48 then causes the leveling linkage 80 to be moved and to pivot about the pivot point 66 in such a way whereby the portion of the handle assembly 60 pivots about the pivot connection 64 in such a way whereby position of the handle 62 is maintained in a generally level desired position with regard to the surface 2 over which the cutting device is being used or moved. This results in significantly less stress upon the body of the user and increases the ease and manageability of the use of such a device.

Referring back to the drawings, FIG. 1 shows the device in its lowered state. FIG. 2 shows the device in a position wherein the front wheel assembly 40 has been activated whereby the hydraulic cylinder pitch controller 41 so as to cause the pitch of the frame 20 relative to the front wheel assembly to be altered. However, comparing the device in FIG. 1 with the device in FIG. 2, it is noted that while the position of the frame 20 relative to the underlying surface 2 has been altered, the position of the handle 62 of the handle assembly has remained in the same generally parallel orientation to the underlying surface 2. This is accomplished by the interaction of the leveling linkage 80 with front wheel assembly 40 and the pivoting portions of the handle assembly 60. The interaction of these various interconnected pieces cause the leveling linkage to absorb the movement of the frame 20 and for the handle portions 62 of the handle assembly to remain in the same general position with regard to the underlying surface.

In the embodiment of the invention shown in FIGS. 1 and 2, the leveling linkage 80 is preferably a rigid member. However, it is to be distinctly understood that the leveling linkage 80 may be a flexible link, such as a cable or chain, or a system of connected links, which are routed and/or shielded in such a way so as to prevent the interference of these linking pieces with the other components of the pavement saw. Further, the "leveling linkage" may be any manner of interconnecting the handle assembly 60 and the front wheel assembly 40 or frame 20 whereby alteration in the pitch of the frame relative to the front wheel assembly is modified so that the position of the handle assembly with an underlying surface remains generally the same. This would include any of a variety of means for performing such a function including but not limited to hydraulic, mechanical or other appropriate devices.

The embodiment of the invention shown in FIGS. 1 and 2 also show a depth control assembly 90 which controls the depth that a saw blade is able to be extended within a cut. In the preferred embodiment of the invention, this depth control assembly 90 functions through the same cylinder 41 that is used to lift and lower the frame 20 and the attached saw blade. However it is to be understood that in other variations of the invention, modifications to this basic configuration may also take place. The depth control assembly 90 functions through a limit switch assembly 92 on an adjustable plate 94 that makes contact with the stay level handlebar 62.

As the saw is lowered, the handlebar's 62 free end 68 moves upwards in relation to the adjustable plate 94 that the limit switch assembly 92 is mounted to. When the handlebar 62 makes contact with the limit switch assembly 92, a portion of the limit switch assembly pivots 92 at the pivot 100 until the internal switch within the switch assembly is activated. When this activation occurs, the electrical current to the hydraulic valve 41 that moves the front wheel assembly 40 and which allows the saw to be lowered any further is interrupted. By interrupting the current to the hydraulic valve 41, the saw blade is prevented from lowering any further, even if the operator attempts to continue to lower the saw cutting depth.

The position of the limit switch assembly 92 is adjustable from the operator control console via a knob 98 interconnected to a threaded rod 96 which can be rotated to raise or lower the adjustable plate 94. The knob 98 allows a user to adjust the point where the limit switch assembly 92 makes contact with the handlebar 62, thus allowing adjustment and variation of the controlled cutting depth of the saw. This depth control system can also be incorporated in saws of a conventional design that do not utilize the handlebar system described above. In such embodiments, the connection of such a switch and its associated pieces and parts may be accomplished by interconnection of these pieces to the front axle assembly or other portion of the device.

Figure 3:
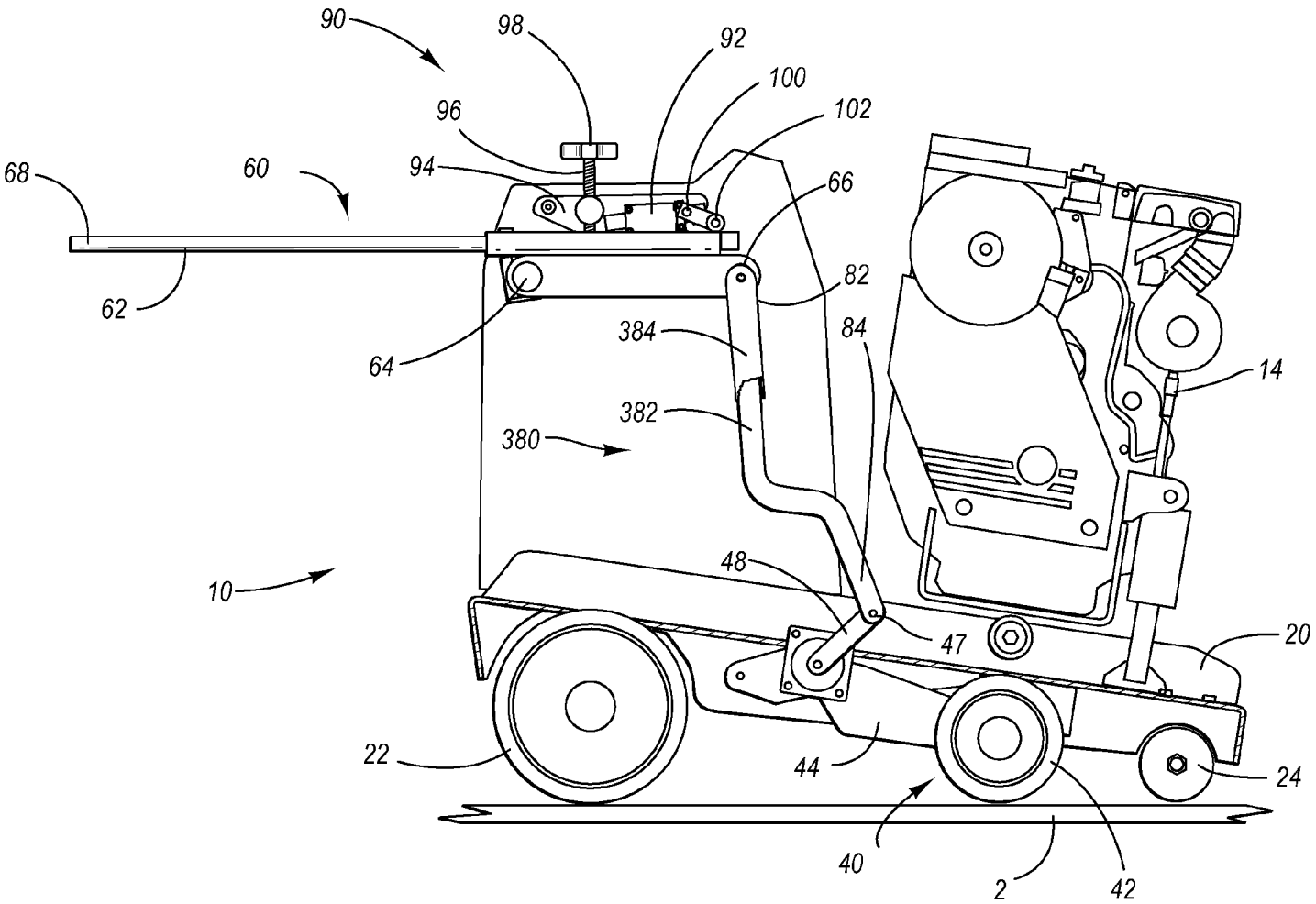
FIG. 3 is a side view of a second embodiment of the invention in a lowered position.
Figure 4:
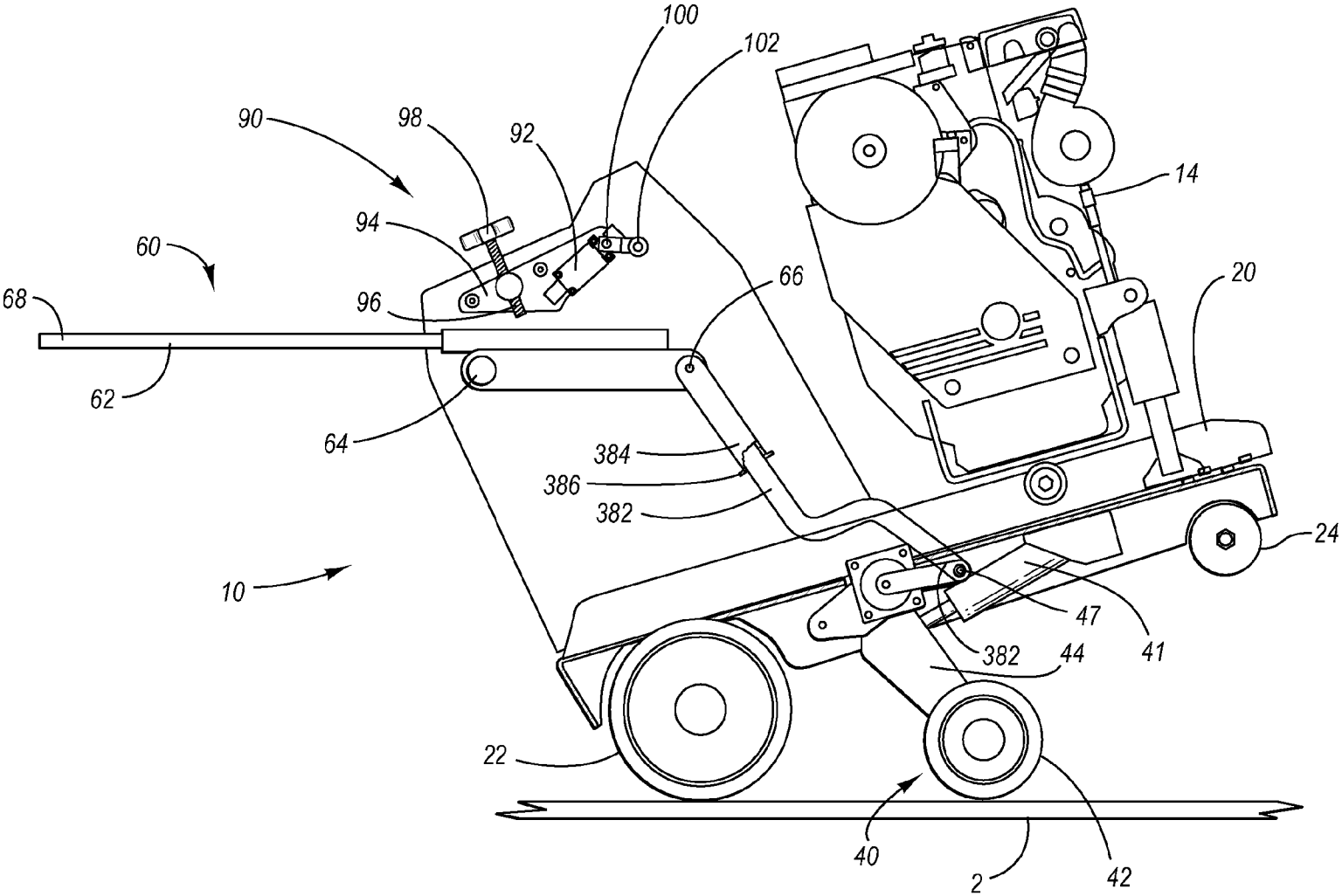
FIG. 4 is a side view of the second embodiment of the invention in a raised position.

Referring now to FIGS. 3 and 4 another embodiment of the invention is shown. In this embodiment of the invention the leveling linkage 380 is made up of two interconnected and interactive pieces 382 and 384 which are configured so that the first interactive piece 382 has a first end that is pivotingly operatively connected to the front wheel assembly 40 through a pivoting connection and a second end that is in sliding engagement with a portion of the second interactive piece 384. This second interactive piece 384 has a first end, which is pivotingly operatively connected to a pivoting portion 66 of a handle assembly 60. This handle assembly also contains a second pivot point 64, and a handle 62 which extends from the pivoting portions 66, 64 back to a free end 68 which is adapted to be grasped by an operator.

The front wheel assembly 40 is pivotingly operatively connected to the frame 20 of the concrete cutter 10, which also has a rear wheel 22, a motor 14 with a saw blade attachment portion 24 and in some instances a guide wheel. For ease of illustration of the parts related to the present invention the large circular saw blade which attaches to the saw blade attachment portion 24 is not shown. An actuating hydraulic cylinder 41 connects a portion of the frame 20 to the front wheel connection assembly 40. This actuating cylinder functions under direction from the operator to lift and lower the frame 20 together with its associated saw blade from a designated position with regard to the surface upon which the device is placed.

When the actuating cylinder device is utilized to raise and lower the pitch of the present invention, the portions 382, 384 of the linkage 380 of the present invention slide in and out of position one with another. If so desired, a connection device 386 such as a bolt, or cotter pin may be utilized to hold these portions of a device in a designated location, and thus maintain the positioning of the handle 62 in a designated position and orientation. In such a configuration, the device will function as a typical concrete saw cutting type of device.

Figure 5:
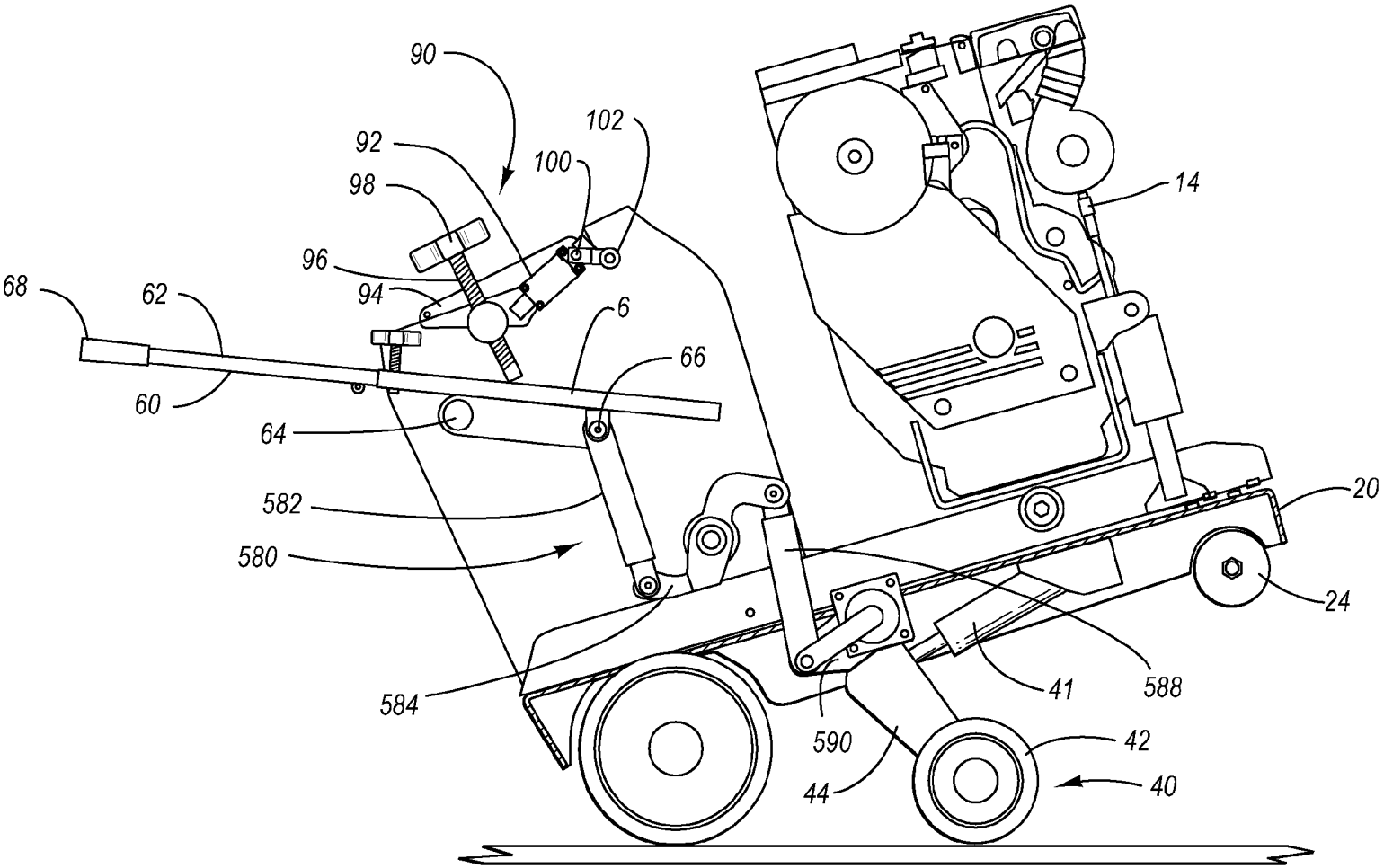
FIG. 5 is a side view of the third embodiment of the invention in a raised position.
Figure 6:
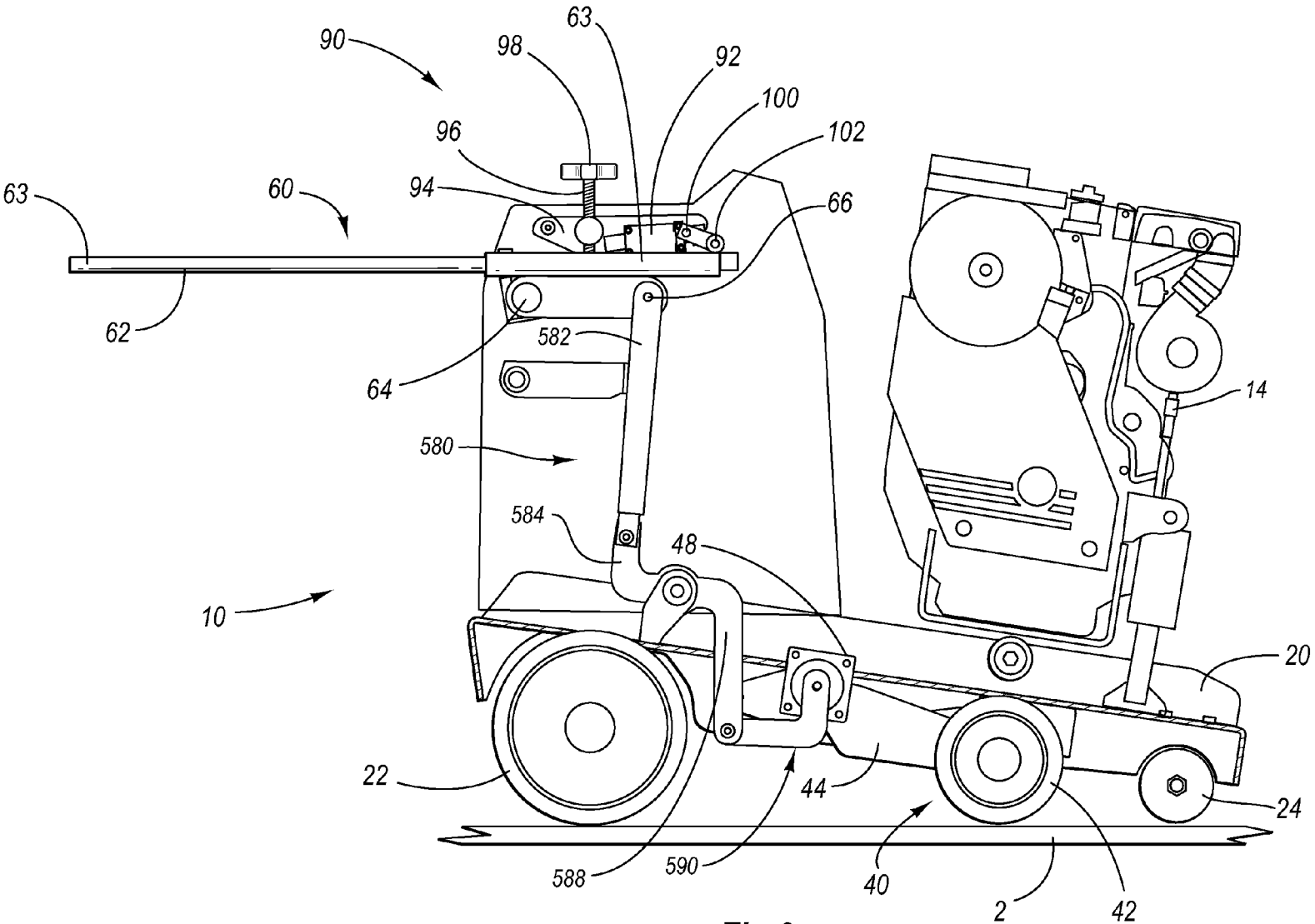
FIG. 6 is a side view of the third embodiment of the invention in a lowered position.

Referring now to FIGS. 5 and 6 another embodiment of the invention is shown. In this embodiment of the invention, the leveling linkage 380 is made up of four interconnected and interactive pieces 582, 584, 588 and 590 which are interconnected through selectively pivoting coordination so as to enable the handle of the device to be maintained in a desired pivoting and operative configuration while the pitch of the cutting blade portions are altered. The first interactive piece 590 has a first end that is pivotingly operatively connected to the front wheel assembly 40 through a pivoting connection and a second end that is pivotally connected to spacer bar 588. This spacer bar connects the first interactive piece 590 with a rocker arm 584 which is pivotally connected to the frame of the device. This rocker arm 584 is also connected to a second spacer bar 582 which is operatively interconnected to a pivoting portion 66 of a handle assembly 60. This handle assembly 60 also contains a second pivot point 64, and a handle 62 which extends from the pivoting portions 66, 64 back to a free end 68 which is adapted to be grasped by an operator.

As in the other embodiments, an actuating hydraulic cylinder 41 connects a portion of the frame 20 to the front wheel connection assembly 40. This actuating cylinder functions under direction from the operator to lift and lower the frame 20 together with its associated saw blade from a designated position with regard to the surface upon which the device is placed.

When the actuating cylinder device is utilized to raise and lower the pitch of the present invention, the portions 582, 584, 588 and 590 of the linkage 580 pivot and adjust so as to compensate for the movement and maintain the handle in a desired position. If so desired, a connection device such as a bolt, or cotter pin may be utilized to hold these portions of the device in a designated location, and prevent pivoting of the pieces. This maintains the position of the handle 62 in a designated position and orientation and allowing the device to function as a typical concrete saw. This particular type of device can also be utilized in conjunction with the depth gauge cutting device 90, which has been previously described.

While shown and described in the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

What is claimed is:

1. A power tool for use upon a surface, said power tool comprising:

a body having a first end and extending to a second end;

at least one handle extending from said second end, said handle oriented generally parallel to said surface, said handle connected to said tool body; and a linkage coupling said tool body and said handle so that said linkage moves proportionally to the vertical movement of said first end thereby keeping said handle generally parallel to said surface.

2. The power tool of claim 1, further comprising a limit switch extending from said tool body adjacent said handle, said limit switch configured for contacting said handle as said handle pivots.

3. The power tool of claim 1 wherein said linkage interacts with pivoting portions of said power tool.

4. The power tool of claim 3 wherein said linkage is a unitary piece.

5. The power tool of claim 3 wherein said linkage is made up of compatible connected sliding pieces.

6. A tool for cutting a surface, said tool having a self leveling handle assembly, said tool having a front portion and a rear portion, said tool comprising:

a frame portion, said frame portion further comprising a rear support assembly for supporting the rear portion of said tool above the surface to be cut;

a front support assembly, said front support assembly comprising a first end extending to a second end, said first end pivotally connecting with a leveling linkage, said second end pivotally connected to said frame, said front support assembly further comprising a pitch controller for controlling the pitch of the front support relative to the frame;

a leveling linkage for pivotally interconnecting said front support assembly with a handle assembly; and a handle assembly for allowing a user to control said tool, said handle assembly pivotally connected to said leveling linkage and said frame, said handle assembly oriented generally parallel to said surface to be cut;

whereby, as said pitch controller changes the relationship of the front support assembly to the rear support assembly, said leveling linkage proportionally transmits said relationship change to said handle assembly thereby resulting in said handle assembly remaining oriented generally parallel to said surface to be cut.

7. The tool of claim 6, wherein said rear support assembly comprises at least one wheel.

8. The tool of claim 6, wherein said front support assembly second end comprises at least one wheel.

9. The tool of claim 6, wherein said pitch controller connects between the frame portion and the front support assembly.

10. The tool of claim 6, wherein said leveling linkage has a first end extending to a second end, said first end pivotally connected with said handle assembly, said second end pivotally connected with said front support assembly.

11. The power tool of claim 6, further comprising a limit switch extending from said frame portion adjacent said handle, said limit switch configured for contacting said handle as said handle pivots, thereby interrupting an electrical current and causing the pitch controller to stop adjusting the pitch any further.

12. A pavement cutting tool having a self leveling handle assembly, said tool comprising:

a frame, said frame having an engine for driving the rotation of an attached saw blade, said frame further comprising a rear wheel assembly for supporting the rear of said pavement cutting tool above a pavement surface, said rear wheel assembly comprising at least one rear wheel;

a front wheel assembly, said front wheel assembly comprising a first end extending to a second end, said second end comprising at least one front wheel, said second end pivotally connected to said frame, said front wheel assembly further comprising a pitch controller for controlling the pitch of the front wheel relative to the frame, said pitch controller connecting between the frame and the front wheel assembly;

a leveling linkage for interconnecting said front wheel assembly with said handle assembly, said leveling linkage having a first end extending to a second end, said first end pivotally connected with said handle assembly, said second end pivotally connected with said front wheel assembly; and a handle assembly for allowing a user to control said tool, said handle assembly comprising at least one handle bar, said handle assembly having a first portion pivotally connected to said frame portion and a second portion pivotally connected to said leveling linkage;

whereby, as said pitch controller changes said pitch, said leveling linkage proportionally transmits said pitch change to said handle bar thereby resulting in said handle bar remaining oriented generally parallel to said pavement surface.

13. A method of controlling the pitch of a pavement cutting tool's handles, said tool for cutting a pavement surface;

providing a pavement cutting tool comprising:

a frame portion having a rear support assembly for supporting the rear of said tool above a pavement surface;

a front support assembly pivotally attached to said frame portion;

a pitch controller connecting between said front support assembly and said frame portion, said pitch controller for controlling the pitch of said front support assembly relative to said frame portion;

a leveling linkage for interconnecting said front support assembly with a handle assembly, said handle assembly for allowing a user to control said tool;

pivotally connecting said handle assembly to said frame portion; and pivotally connecting a leveling linkage between said handle assembly and said front support assembly;

wherein as said pitch controller changes said pitch, said leveling linkage proportionally transmits said pitch change to said handle assembly thereby resulting in said handle assembly remaining oriented generally parallel to said pavement surface.

* * * * *